US011041451B2

(12) United States Patent
Kinjo

(10) Patent No.: US 11,041,451 B2
(45) Date of Patent: Jun. 22, 2021

(54) INTERNAL COMBUSTION ENGINE CONTROL METHOD AND INTERNAL COMBUSTION ENGINE CONTROL DEVICE

(71) Applicant: NISSAN MOTOR CO., LTD., Yokohama (JP)

(72) Inventor: Ken Kinjo, Kanagawa (JP)

(73) Assignee: NISSAN MOTOR CO., LTD., Yokohama (JP)

( * ) Notice: Subject to any disclaimer, the term of this patent is extended or adjusted under 35 U.S.C. 154(b) by 0 days.

(21) Appl. No.: 16/765,957

(22) PCT Filed: Nov. 22, 2017

(86) PCT No.: PCT/JP2017/041970
§ 371 (c)(1),
(2) Date: May 21, 2020

(87) PCT Pub. No.: WO2019/102540
PCT Pub. Date: May 31, 2019

(65) Prior Publication Data

US 2020/0355128 A1 Nov. 12, 2020

(51) Int. Cl.
*F02D 29/02* (2006.01)
*F02D 41/04* (2006.01)
(Continued)

(52) U.S. Cl.
CPC ..... *F02D 29/02* (2013.01); *F02D 41/042* (2013.01); *F02D 41/065* (2013.01);
(Continued)

(58) Field of Classification Search
CPC ..... F02D 29/02; F02D 41/045; F02D 41/065; F02D 2200/1002; B60W 10/06
See application file for complete search history.

(56) References Cited

U.S. PATENT DOCUMENTS 8,214,112 B2 7/2012 Rew et al.
2004/0106498 A1* 6/2004 Badillo ..... F16H 63/502 477/109

(Continued)

FOREIGN PATENT DOCUMENTS

EP 2 913 505 A1 9/2015
JP 2002-364403 A 12/2002
JP 2004-44800 A 2/2004

*Primary Examiner* — Sizo B Vilakazi
*Assistant Examiner* — Anthony L Bacon
(74) *Attorney, Agent, or Firm* — Foley & Lardner LLP

(57) ABSTRACT

A control method for an internal combustion engine in which a driving force is transmitted through a clutch to a driving wheel of a vehicle, the control method includes: when the internal combustion engine which is automatically stopped in a state where the clutch is disengaged is restarted, performing a torque down control to decrease a target torque of the internal combustion engine when the clutch is engaged; and setting a target torque in the torque down control, to a predetermined torque lower limit value determined in accordance with a driving state, the torque lower limit value including at least one of a predetermined full open value set when an accelerator opening degree is full open, and a predetermined full close value set when the accelerator opening degree is full close.

6 Claims, 6 Drawing Sheets

(51) Int. Cl.
*F02D 41/06* (2006.01)
*F02D 41/40* (2006.01)

(52) U.S. Cl.
CPC ..... *F02D 41/401* (2013.01); *F02D 2200/101* (2013.01); *F02D 2200/602* (2013.01)

(56) References Cited

U.S. PATENT DOCUMENTS

| | | | | |
|---|---|---|---|---|
| 2015/0197252 | A1* | 7/2015 | Tinker | F16H 61/143 477/54 |
| 2016/0046282 | A1* | 2/2016 | Yamazaki | B60W 10/06 477/5 |
| 2016/0059846 | A1* | 3/2016 | Wang | B60W 20/40 477/5 |

* cited by examiner

INTERNAL COMBUSTION ENGINE CONTROL METHOD AND INTERNAL COMBUSTION ENGINE CONTROL DEVICE

TECHNICAL FIELD

This invention relates to a control method for an internal combustion engine, and a control device for the internal combustion engine.

BACKGROUND ART

It is known to improve a fuel economy by inertia travel by stopping an internal combustion engine when an accelerator is in an OFF state (accelerator OFF state) during driving of the vehicle.

For example, a patent document 1 discloses an art to stop the engine (the internal combustion engine) after the interruption of the transmission of the engine brake torque by disengaging the clutch when the inertia traveling is sensed, to control the engine speed so that a rotation speed difference between the engine speed and the rotation speed of the driving system becomes a predetermined rotation speed difference when the engine is again connected to the driving system, and then to engage the clutch.

However, in the patent document 1, a torque step (torque level difference) before and after the clutch at the clutch engagement is not considered.

Even when the rotation speeds before and after the clutch are synchronized with each other at the clutch engagement, the shock by the torque step is generated in a case where the torque step before and after the clutch is generated.

Therefore, in the patent document 1, the shock may be generated to provide the unnatural feeling to the driver at the clutch engagement.

PRIOR ART DOCUMENT

Patent Document

Japanese Patent Application Publication No. 2004-44800

SUMMARY OF THE INVENTION

An internal combustion engine comprises: when the internal combustion engine which is automatically stopped in a state where the clutch is disengaged is restarted, performing a torque down control to decrease a target torque of the internal combustion engine when the clutch is engaged; and setting a target torque in the torque down control, to a predetermined torque lower limit value determined in accordance with a driving state.

In the present invention, the lower limit value of the torque suppression at the clutch engagement is set in accordance with the driving state. With this, it is possible to ensure the response characteristic (the acceleration characteristic) of the vehicle at the restart of the internal combustion engine which is automatically stopped, and to suppress the engagement shock at the clutch engagement.

DESCRIPTION OF EMBODIMENTS

Hereinafter, an outline of one embodiment of the present invention is explained in detail with reference to the drawings.

Figure 1:
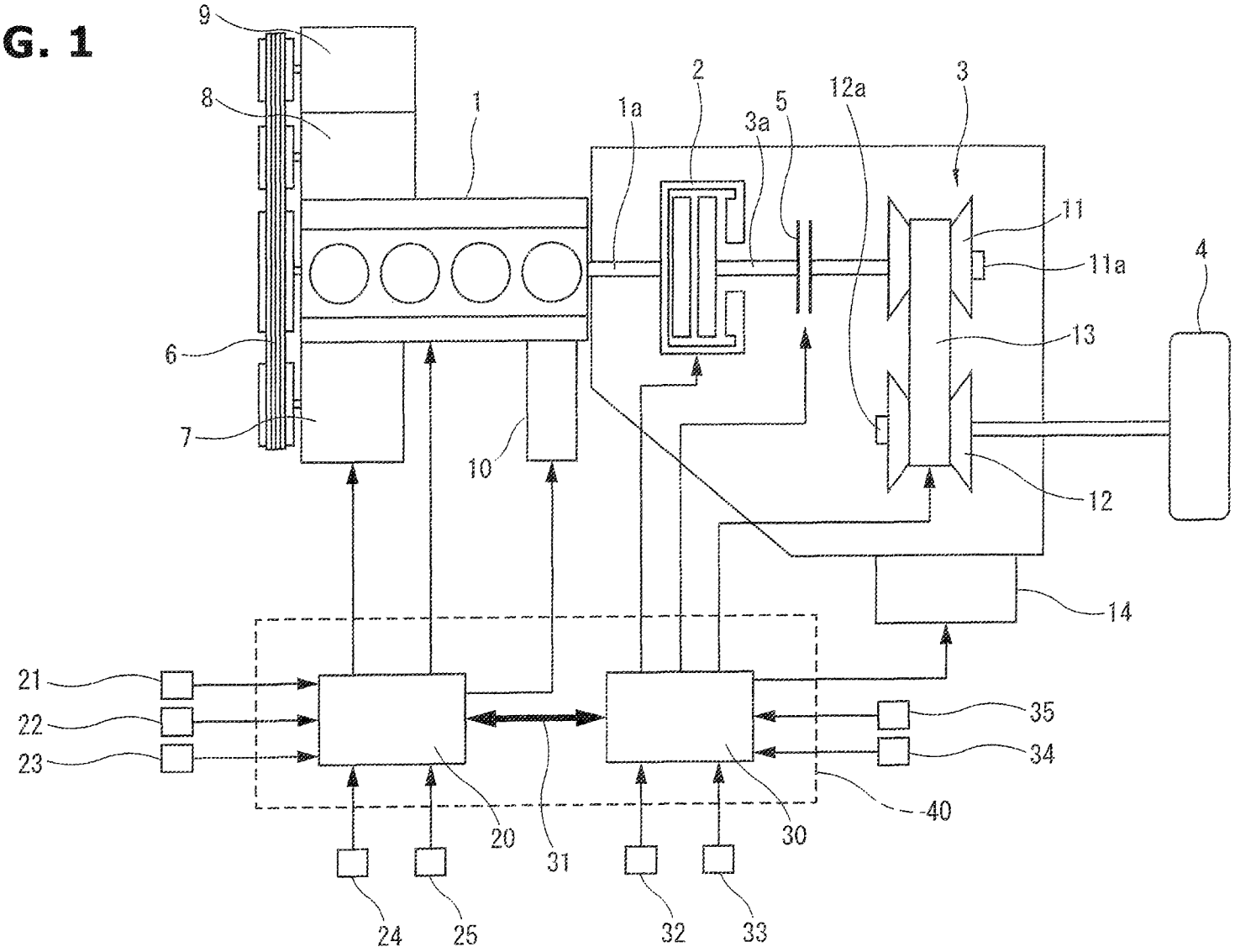
FIG. 1 is an explanation view schematically showing an outline of a control device of an internal combustion engine according to the present invention.

FIG. 1 is an explanation view schematically showing an outline of a control device of an internal combustion engine 1 according to the present invention.

The internal combustion engine 1 is a driving source for a vehicle. The internal combustion engine 1 is connected through a torque converter 2 including a lockup mechanism, to a CVT (continuously variable transmission) 3 which is a transmission.

The lockup mechanism is a mechanical clutch installed in the torque converter 2. The lockup mechanism is arranged to connect the internal combustion engine 1 and the CVT 3 through the torque converter 2, by a lockup clutch disengagement. Moreover, the lockup mechanism is arranged to directly connect an output shaft 1*a* of the internal combustion engine, and a CVT input shaft 3*a* by lockup clutch engagement. This lockup mechanism is arranged to be controlled among the engagement, a slip engagement, and the disengagement by an LU actual hydraulic pressure produced based on an LU command pressure from a TCU 30 described later.

The CVT 3 is arranged to transmit the power through a final speed reduction device (not shown) to driving wheels 4, like a normal automobile. Moreover, in this embodiment, a forward clutch 5 is disposed between the torque converter 2 and the CVT 3.

That is, the internal combustion engine 1, the torque converter 2, the forward clutch 5, the CVT 3, and the driving wheels 4 are disposed in this order in series with each other in a power transmitting path by which the driving force by the internal combustion engine 1 is transmitted to the driving wheels 4.

The driving force is transmitted from the engine 1, through the lockup clutch of the lockup mechanism of the torque converter 2, and the forward clutch 5 to the driving wheels 4 of the vehicle.

The internal combustion engine 1 is arranged to drive a motor 7, a water pump 8, and a compressor 9 for an air conditioner through a belt 6.

The motor 7 is arranged to provide the driving force to the internal combustion engine 1, and to generate the electric power.

Moreover, the internal combustion engine 1 is provided with a starter motor 10 used at the start of the internal combustion engine 1, in addition to the motor 7. Besides, in a case where the motor 7 is used for the start of the internal combustion engine 1, it is possible to omit the starter motor 10.

The CVT 3 includes a primary pulley 11, a secondary pulley 12, and a V belt 13 wound around V grooves of the primary pulley 11 and the secondary pulley 12. The primary pulley 11 includes a primary hydraulic cylinder 11*a*. The secondary pulley 12 includes a secondary hydraulic cylinder 12*a*. A width of the V groove of the primary pulley 11 is varied by adjusting the hydraulic pressure supplied to the primary hydraulic cylinder 11*a*. A width of the V groove of the secondary pulley 12 is varied by adjusting the hydraulic pressure supplied to the secondary hydraulic cylinder 12*a*.

In the CVT 3, the widths of the V grooves are varied by controlling the hydraulic pressures supplied to the primary hydraulic cylinder 11*a* and the secondary hydraulic cylinder 12*a*, so that the contact radii between the V belt 13, and the primary pulley 11 and the secondary pulley 12 are varied. Consequently, the transmission gear ratio is continuously varied.

The hydraulic pressure is supplied to the CVT 3 by a mechanical oil pump (not shown) which is a first oil pump, and which is driven by the internal combustion engine 1, and an electric oil pump 14 which is a second oil pump. That is, the hydraulic pressure is supplied from the mechanical oil pump or the electric oil pump 14 to the primary hydraulic cylinder 11*a* and the secondary hydraulic cylinder 12*a*. The electric oil pump 14 is arranged to be driven when the internal combustion engine 1 is automatically stopped during the driving of the vehicle by an idling stop and so on. That is, the electric oil pump 14 is operated when the mechanical oil pump is stopped.

Besides, the hydraulic fluid is supplied to the torque converter 2 and the forward clutch 5 by the mechanical oil pump or the electric oil pump 14. That is, the mechanical oil pump or the electric oil pump 14 is a supply source of the hydraulic fluid for the lockup clutch of the lockup mechanism of the torque converter 2 and the forward clutch 5.

The forward clutch 5 is a clutch disposed between the internal combustion engine 1 and the driving wheels 4. The forward clutch 5 is arranged to disconnect the internal combustion engine 1 and the CVT 3 in a disengagement state. The forward clutch 5 is provided to the CVT input shaft 3*a*. The forward clutch 5 is arranged to be in an engagement state so that the power can be transmitted between the internal combustion engine 1 and the driving wheels 4. The forward clutch 5 is arranged to be in the disengagement state so that the power (torque) cannot be transmitted between the internal combustion engine 1 and the driving wheels 4. That is, when the forward clutch 5 is disengaged, the internal combustion engine 1 and the driving wheels 4 are disconnected. Moreover, when the forward clutch 5 is disengaged, the internal combustion engine 1 and the CVT 3 is disconnected.

The internal combustion engine 1 is controlled by an ECU (engine control unit) 20. The ECU 20 is a known digital computer including a CPU, a ROM, a RAM, and an input and output interface.

The ECU 20 receives detection signal of various sensors such as a crank angle sensor 21 arranged to sense a crank angle of a crank shaft (not shown) of the internal combustion engine 1, an accelerator opening degree sensor 22 arranged to sense a depression amount of an accelerator pedal (not shown), a brake switch 23 arranged to sense an operation of a brake pedal (not shown), a vehicle speed sensor 24 arranged to sense a vehicle speed, and an acceleration sensor 25 arranged to sense an acceleration of the vehicle. The crank angle sensor 21 is arranged to sense an engine speed Re of the internal combustion engine 1.

The ECU 20 is configured to appropriately control an injection amount and an injection timing of a fuel injected from a fuel injection valve (not shown) of the internal combustion engine 1, an ignition timing and an intake air amount of the internal combustion engine 1, and so on, based on the detection signal of the various sensors. Moreover, the ECU 20 is configured to appropriately control the motor 7 and the starter motor 10.

Besides, the ECU 20 receives information relating to a battery SOC and so on of a battery mounted on the vehicle.

The CVT 3 is controlled by a TCU (transmission control unit) 30. The TCU 30 is a known digital computer including a CPU, a ROM, a RAM, and an input and output interface.

The ECU 20 and the TCU 30 are connected by a CAN communication line 31. The data can be exchanged between the ECU 20 and the TCU 30 by the CAN communication line 31.

The TCU 30 receives the detection signal of the above-described accelerator opening degree sensor 22, the brake switch 23, and the vehicle speed sensor 24 through the CAN communication line 31.

Moreover, the TCU 30 receives detection signal of various sensors such as a primary rotation speed sensor 32 arranged to sense a rotation speed Rp of the primary pulley 11 which is an input side rotation speed of the CVT 3, a secondary pulley rotation speed sensor 33 arranged to sense a rotation speed of the secondary pulley 12 which is an output side rotation speed of the CVT 3, a hydraulic pressure sensor 34 arranged to sense the hydraulic pressure of the hydraulic fluid supplied to the CVT 3, and an inhibitor switch 35 arranged to sense a position of a select lever arranged to select a traveling range.

The TCU 30 is configured to appropriately control the transmission gear ratio of the CVT 3, the torque converter 2, and the forward clutch 5 based on the inputted detection signal of the various sensors. Moreover, the TCU 30 controls the driving of the electric oil pump 14.

When a predetermined automatic stop condition is satisfied during the traveling of the vehicle, the internal combustion engine 1 is automatically stopped by the stop of the fuel supply. Then, when a predetermined automatic restart condition is satisfied during the automatic stop of the internal combustion engine 1, the internal combustion engine is restarted by the restart of the fuel supply.

The automatic stop of the internal combustion engine 1 during the traveling is a coast stop and a sailing stop.

The coast stop is performed when a coast stop execution condition which is the automatic stop condition is satisfied during the traveling of the vehicle. The internal combustion engine 1 in the coast stop state is restarted when a coast stop cancel condition which is the automatic restart condition is satisfied.

The coast stop execution condition is satisfied, for example, in a case where the battery SOC is equal to or greater than a predetermined value during the deceleration in a state where the brake pedal is depressed. In the specification, the state where the brake pedal is depressed is an ON state of the brake switch 23.

The coast stop cancel condition is satisfied, for example, in a case where the accelerator pedal is depressed, in a case where the brake pedal is not depressed, or in a case where an electric power of the vehicle is needed to be ensured when the battery SOC becomes equal to or smaller than a predetermined value, and so on. In the specification, the state where the accelerator pedal is depressed is the ON state of the accelerator. Moreover, in the specification, the state where the brake pedal is not depressed is a state where the foot is apart from the brake pedal, that is, the OFF state of the brake switch 23.

In this embodiment, the coast stop state is defined by a state where the internal combustion engine 1 is automatically stopped during the deceleration in the depressed state of the brake pedal at the low vehicle speed. At the coast stop, the forward clutch 5 is engaged. The lockup clutch of the lockup mechanism of the torque converter 2 is disengaged.

The sailing stop is performed when a sailing stop execution condition which is the automatic stop condition is satisfied during the traveling of the vehicle. The internal combustion engine 1 in the sailing stop state is restarted when a sailing stop cancel condition which is the automatic restart condition is satisfied.

The sailing stop execution condition is satisfied, for example, in a case where the battery SOC is equal to or greater than the predetermined value when the accelerator pedal is switched from the depressed state to the undepressed state during the traveling of the vehicle. That is, the sailing stop condition is satisfied when there is no driving force request. In the specification, the undepressed state of the accelerator pedal is the state where the foot is apart from the accelerator pedal, that is, the OFF state of the accelerator.

The sailing stop cancel condition is satisfied, for example, in a case where the accelerator pedal is depressed, in a case where the brake pedal is not depressed, or in a case where the electric power of the vehicle is needed to be ensured when the battery SOC becomes equal to or smaller than the predetermined value, and so on.

In this embodiment, the sailing stop state is defined by a state where the internal combustion engine 1 is automatically stopped during an inertia traveling in which the brake pedal is not depressed in a middle or high vehicle speed. At the sailing stop, the forward clutch 5 is disengaged. The lockup clutch of the lockup mechanism of the torque converter 2 is engaged.

In a case where the vehicle is accelerated by the restart of the internal combustion engine 1 during the coast stop or the sailing stop, the disengaged clutch is needed to be engaged. When the disengaged clutch is engaged, a torque down control (torque decrease control) is performed to decrease a target torque of the internal combustion engine 1.

In this embodiment, the target torque of this torque down control is set to be equal to or greater than a predetermined torque lower limit value Tmin determined in accordance with the driving state. Moreover, a timing of the end of the torque down control is defined by a predetermined torque release time period $t_{trq}$ according to the driving state. The torque release time period $t_{trq}$ is a time period from a timing at which a rotation speed difference between the internal combustion engine 1 and the primary pulley 11 becomes a first predetermined value A during the torque down control, to a timing of the end of the toque down control. That is, the torque release time period $t_{trq}$ is a time period from the engagement command of the clutch (the lockup clutch or the forward clutch 5) which is generated during the torque down control, to the end of the torque down control.

The torque lower limit value Tmin is set to compensate for (cover) the traveling resistance of the vehicle, and the resistance of the power train of the vehicle.

Specifically, the torque lower limit value Tmin is set to be greater as the vehicle speed is higher. Moreover, the torque lower limit value Tmin is set to be greater as the accelerator opening degree is greater. That is, when the vehicle speed or the accelerator opening degree is large, the torque lower limit value Tmin is set to be greater than that when the vehicle speed or the accelerator opening degree is small.

The torque lower limit value Tmin is calculated, for example, by using the vehicle speed and the accelerator opening degree. For example, the ECU 20 or the TCU 30 stores a torque lower limit value calculation map showing the torque lower limit value Tmin corresponding to the vehicle speed and the accelerator opening degree. With this, it is possible to calculate the torque lower limit value Tmin. Besides, it is optional to calculate the torque lower limit value Tmin from a predetermined equation (expression) by using the vehicle speed and the accelerator opening degree.

The torque release time period $t_{trq}$ is set to compensate for (cover) the traveling resistance and the resistance of the power train of the vehicle.

Specifically, the torque release time period $t_{trq}$ is set to be shorter as the vehicle speed during the torque down control is higher. Moreover, the torque release time period $t_{trq}$ is set to be shorter as the accelerator opening degree during the torque down control is greater. That is, when the vehicle speed or the accelerator opening degree during the torque down control is large, the torque release time period $t_{trq}$ is set to be shorter than that when the vehicle speed or the accelerator opening degree during the torque down control is small.

The torque release time period $t_{trq}$ is calculated, for example, by using the vehicle speed and the accelerator opening degree. For example, the ECU 20 or the TCU 30 stores a torque release time period calculation map showing the torque release time period $t_{trq}$ corresponding to the vehicle speed and the accelerator opening degree. With this, it is possible to calculate the torque release time period $t_{trq}$. Besides, it is optional to calculate the torque release time period $t_{trq}$ from a predetermined equation (expression) by using the vehicle speed and the accelerator opening degree.

In this embodiment, the ECU 20 and the TCU 30 are linked with each other. Accordingly, it is possible to consider the ECU 20 and the TCU 30 as a CU (control unit) 40. Accordingly, in this embodiment, the CU 40 including the ECU 20 and the TCU 30 corresponds to a torque down control section configured to perform the torque down control when the lockup clutch of the lockup mechanism of the torque converter 2 or the forward clutch 5 is engaged, a torque lower limit value calculation section configured to calculate the torque lower limit value Tmin, and a torque release time period calculation section configured to calculate the torque release time period $t_{trq}$. Besides, the CU 40 is configured to automatically stop the internal combustion engine 1 when the automatic stop condition is satisfied.

Figure 2:
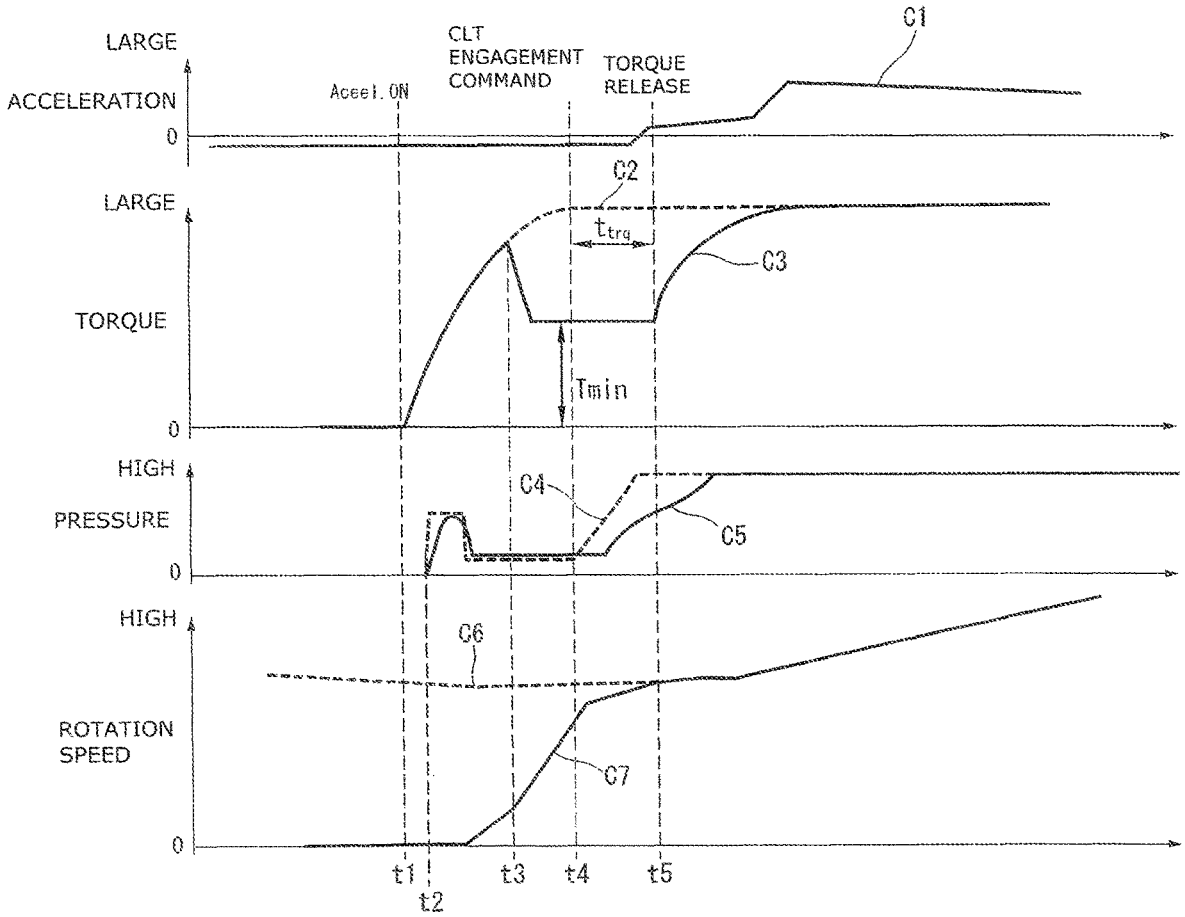
FIG. 2 is a timing chart of a torque down control of the internal combustion engine in the present invention.

FIG. 2 is a timing chart for explaining the torque down control of the internal combustion engine 1 in this embodiment, by exemplifying the sailing stop.

A characteristic line C1 shown by a solid line in FIG. 2 represents an acceleration Ga in the forward and rearward directions of the vehicle.

A characteristic line C2 shown by a broken line in FIG. 2 represents a target torque Tv of the internal combustion engine 1 when the torque down control is not performed. A characteristic line C3 shown by a solid line in FIG. 2 represents a target torque Tt of the internal combustion engine 1 when the torque down control is performed.

A characteristic line C4 shown by a solid line in FIG. 2 represents a target pressure Pt of the hydraulic fluid supplied to the forward clutch 5. A characteristic line C5 shown by a broken line in FIG. 2 represents an actual pressure Pa of the hydraulic fluid supplied to the forward clutch 5.

A characteristic line C6 shown by a broken line in FIG. 2 represents a rotation speed Rp of the primary pulley 11. A characteristic line C7 shown by a solid line in FIG. 2 represents an engine speed Re of the internal combustion engine 1.

Time t1 is a timing of the accelerator ON. The internal combustion engine 1 starts the cranking at this time t1. At time t1, the sailing stop cancel condition is satisfied. The internal combustion engine 1 starts the cranking at this time t1. That is, the internal combustion engine 1 is restarted at time t1.

Time t2 is a timing at which a pre-charge is performed to suppress a delay of the hydraulic response of the forward clutch 5. Time t2 is a timing at which a predetermined time period is elapsed from the timing of the accelerator ON. After the pre-charge, the hydraulic pressure of the forward clutch 5 is controlled to be smaller than the hydraulic pressure by which the torque transmission is started, until the engagement command of the forward clutch 5 is outputted.

Time t3 is a timing at which the engine speed Re of the internal combustion engine 1 is increased to be closer to the rotation speed Rp of the primary pulley 11 so that the rotation speed difference between the internal combustion engine 1 and the primary pulley 11 becomes a second predetermined value B. When the rotation speed difference between the internal combustion engine 1 and the primary pulley 11 becomes the second predetermined value B, the torque down control is started. That is, the torque down control is performed when the rotation speed difference between the internal combustion engine 1 and the primary pulley 11 becomes equal to or smaller than the second predetermined value B.

When the torque down control is started, the target torque Tt of the internal combustion engine 1 is limited to the torque lower limit value Tmin.

Time t4 is a timing at which the rotation speed difference between the internal combustion engine 1 and the primary pulley 11 becomes the first predetermined value A.

When the rotation speed difference between the internal combustion engine 1 and the primary pulley 11 becomes the first predetermined value A, the engagement command of the forward clutch 5 is outputted to increase the target pressure Pt of the hydraulic pressure supplied to the forward clutch 5. The actual pressure Pa of the hydraulic pressure supplied to the forward clutch 5 is increased in accordance with the increase of the target pressure Pt of the hydraulic fluid supplied to the forward clutch 5, so that the forward clutch 5 is engaged. The first predetermined value A is smaller than the second predetermined value B.

The driving torque of the internal combustion engine 1 is transmitted to the primary pulley 11 by the engagement of the forward clutch 5 after the engagement command of the forward clutch 5. Then, the acceleration (the forward and rearward G) of the vehicle becomes a positive value when the vehicle is started to be accelerated.

Moreover, at time t4, a timer to measure a timing of the end of the torque down control is started. That is, the timer is started at a timing at which the engagement command of the forward clutch 5 during the torque down control is outputted. That is, the timer is started to count at a timing at which the clutch engagement command is outputted.

In case of the coast stop, the timer is started at a timing at which the engagement command of the lockup clutch is outputted.

Time t5 is a timing at which the torque release time period $t_{trq}$ is elapsed from time t4. The torque down control is finished at a timing (time t5) at which the torque release time period $t_{trq}$ is elapsed from a timing at which the rotation speed difference between the internal combustion engine 1 and the primary pulley 11 becomes the first predetermined value A during the toque down control. That is, the torque down control is finished at a timing (time t5) at which the torque release time period $t_{trq}$ is elapsed from the engagement command of the forward clutch 5 which is generated during the torque down control.

Besides, the torque down control in case of the coast stop is finished at a timing at which the torque release time period $t_{trq}$ is elapsed from the engagement command of the lockup clutch which is generated during the torque down control.

The toque release time period $t_{trq}$ is sequentially calculated during the torque down control. At time t5, the internal combustion engine 1 is released from the torque limitation in which the target torque Tt is limited to the torque lower limit value Tmin.

The acceleration feeling and the deceleration feeling sensed by the driver at the engagement of the forward clutch 5 and the lockup clutch of the lockup mechanism of the torque converter 2 is not generally problematic. This acceleration feeling and the deceleration feeling are dissolved during a relatively short time period. However, these may provide the unnatural feeling to the driver.

Figure 3:
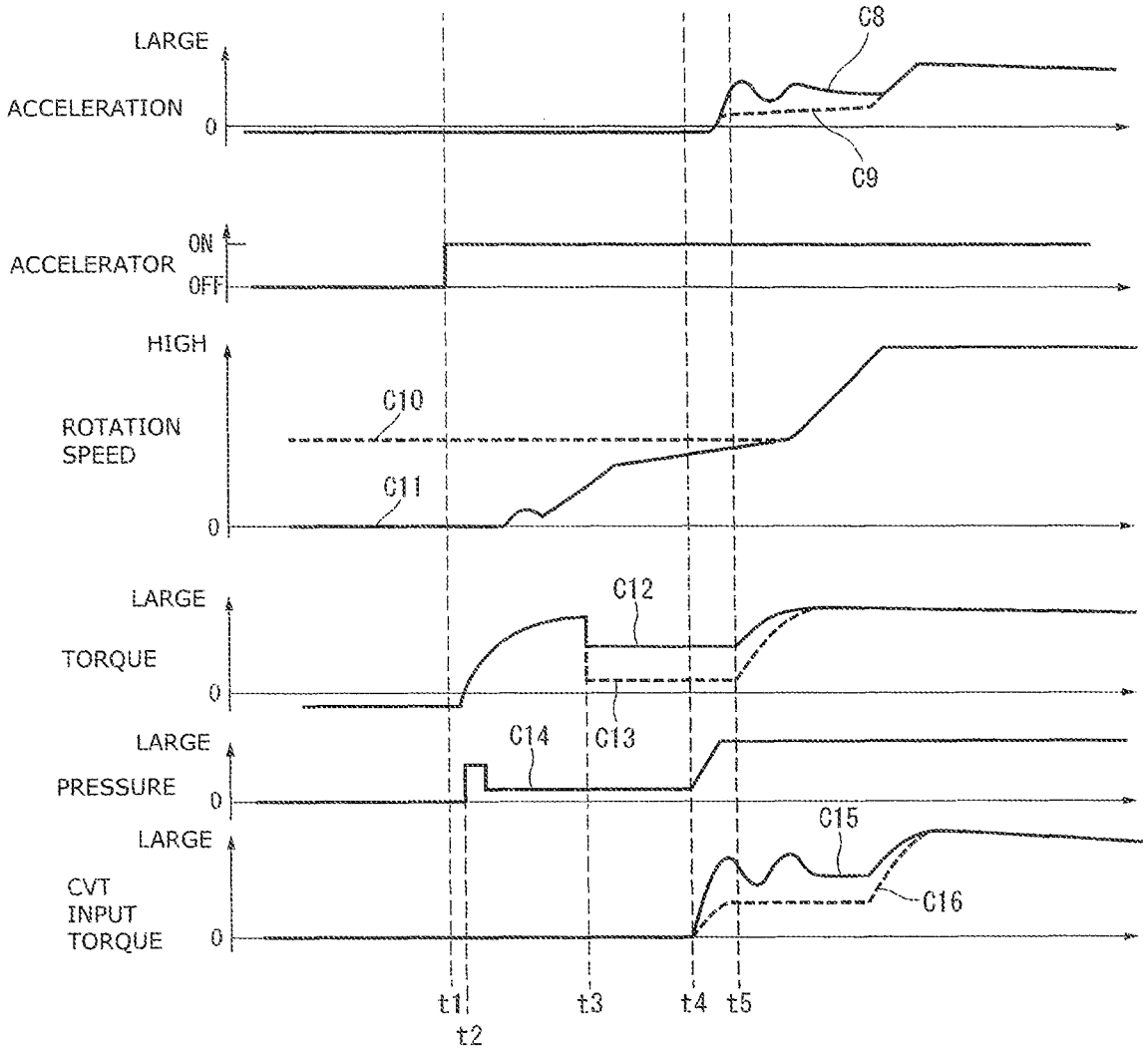
FIG. 3 is a timing chart of a torque down control of a first comparative example.

FIG. 3 is a timing chart for explaining the torque down control in a first comparative example, by exemplifying the sailing stop. A system configuration of the first comparative example is identical to that of the above-described embodiment of the present invention. Accordingly, the same constitution components have the same symbols. The repetitive explanations are omitted.

A characteristic line C8 shown by a solid line in FIG. 3 represents an acceleration Gc1 in the forward and rearward directions of the vehicle in the first comparative example. A characteristic line C9 shown by a broken line in FIG. 3 represents an acceleration Gc0 when the torque of the internal combustion engine 1 during the torque down control is set to the torque lower limit value Tmin, like the above-described embodiment.

A characteristic line C10 shown by a broken line in FIG. 3 represents a rotation speed Rp of the primary pulley 11 in the first comparative example. A characteristic line C11 shown by a solid line in FIG. 3 represents an engine speed Re of the internal combustion engine 1 in the first comparative example.

A characteristic line C12 shown by a solid line in FIG. 3 represents a target torque Tt1 of the internal combustion engine 1 in the first comparative example. A characteristic line C13 shown by a broken line in FIG. 3 represents a target torque Tt when the torque of the internal combustion engine 1 during the torque down control is set to the torque lower limit value Tmin like the above-described embodiment.

A characteristic line C14 shown by a solid line in FIG. 3 represents a target pressure Pt of the hydraulic fluid supplied to the forward clutch 5.

A characteristic line C15 shown by a solid line in FIG. 3 represents a torque Tc1 inputted to the CVT 3 in this first comparative example. A characteristic line C16Tc shown by a broken line in FIG. 3 represents a torque Tc inputted to the CVT 3 in the above-described embodiment.

Time t1 in FIG. 3 is a timing of the accelerator ON. Time t2 in FIG. 3 is a timing at which a pre-charge is performed to suppress a delay of the hydraulic response of the forward clutch 5. Time t3 in FIG. 3 is a timing at which the torque down control is started. Time t4 in FIG. 3 is a timing at which the engagement command of the forward clutch 5 is outputted. Time t5 in FIG. 3 is a timing at which the torque down control is finished.

In this first comparative example, the target torque Tt1 of the internal combustion engine 1 during the torque down control is excessive. That is, in the first comparative example, the target torque Tt1 of the internal combustion engine during the torque down control is set to be greater than the target torque Tt of the internal combustion engine during the torque down control in the above-described embodiment.

Accordingly, the sudden torque variation is transmitted to the CVT 3 at the engagement of the forward clutch 5, so that the shock is generated. This shock is appeared as the variation of the forward and rearward acceleration.

That is, in a case where the target torque Tt1 of the internal combustion engine 1 is high during the torque down control like the first comparative example, the driver may feel, as the unnatural feeling, the acceleration feeling sensed at the engagement of the forward clutch 5 when the torque step (torque level difference) becomes large at the engagement of the forward clutch 5.

Figure 4:
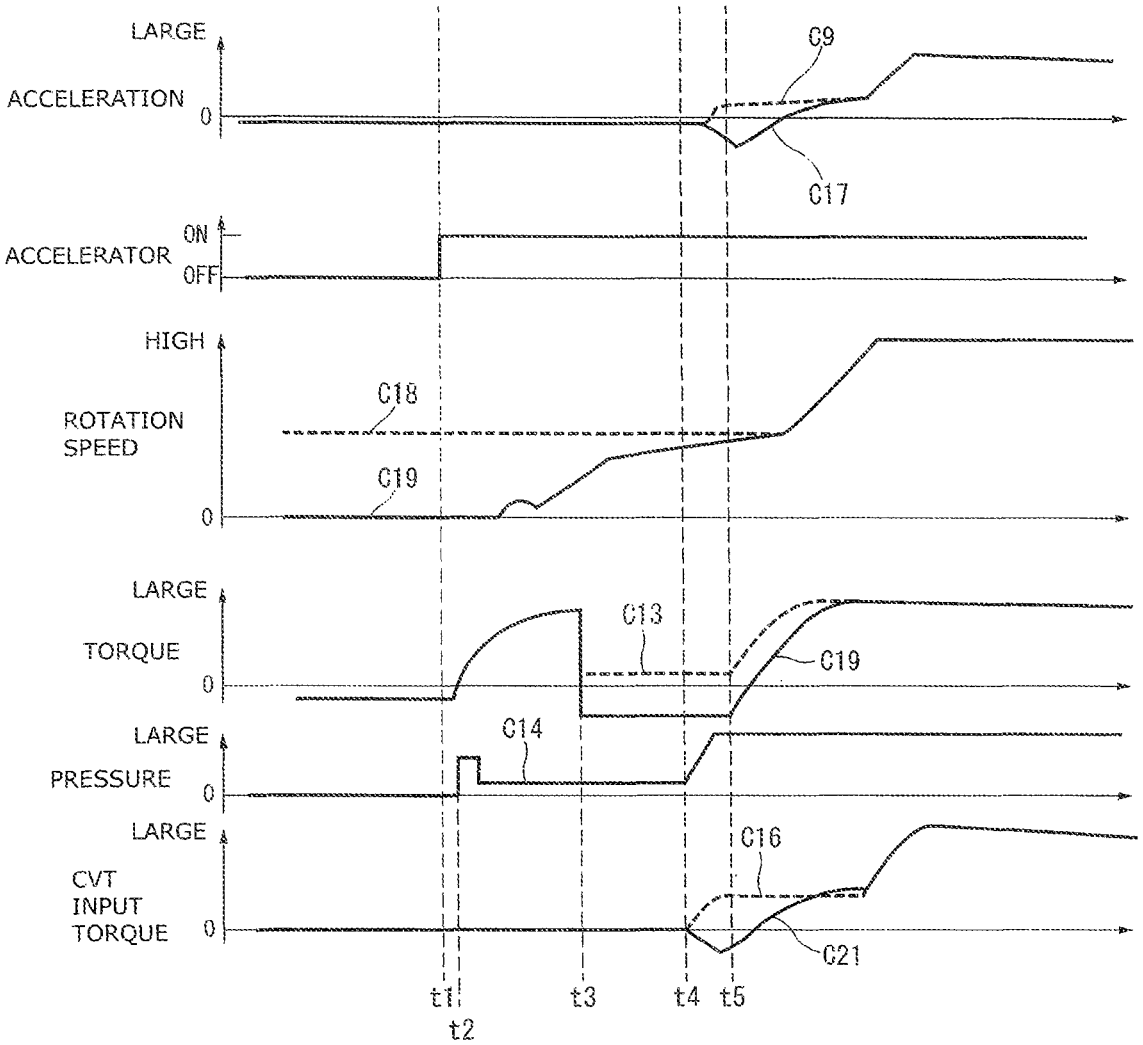
FIG. 4 is a timing chart of a torque down control of a second comparative example.

FIG. 4 is a timing chart for explaining the torque down control in a second comparative example, by exemplifying the sailing stop. A system configuration of the second comparative example is identical to that of the above-described embodiment of the present invention. Accordingly, the same constitution components have the same symbols. The repetitive explanations are omitted.

A characteristic line C17 shown by a solid line in FIG. 4 represents an acceleration Gc2 in the forward and rearward directions of the vehicle in the second comparative example. A characteristic line C9 shown by a broken line in FIG. 4 represents an acceleration Gc0 when the torque of the internal combustion engine 1 during the torque down control is set to the torque lower limit value Tmin, like the above-described embodiment.

A characteristic line C18 shown by a broken line in FIG. 4 represents a rotation speed Rp of the primary pulley 11 in the second comparative example. A characteristic line C19 shown by a solid line in FIG. 4 represents an engine speed Re of the internal combustion engine 1 in the second comparative example.

A characteristic line C20 shown by a solid line in FIG. 4 represents a target torque Tt2 of the internal combustion engine 1 in the second comparative example. A characteristic line C13 shown by a broken line in FIG. 4 represents a target torque Tt when the torque of the internal combustion engine 1 during the torque down control is set to the torque lower limit value Tmin like the above-described embodiment.

A characteristic line C14 shown by a solid line in FIG. 4 represents a target pressure Pt of the hydraulic fluid supplied to the forward clutch 5.

A characteristic line C21 shown by a solid line in FIG. 4 represents a torque Tc2 inputted to the CVT 3 in this second comparative example. A characteristic line C16 shown by a broken line in FIG. 4 represents a torque Tc inputted to the CVT 3 in the above-described embodiment.

Time t1 in FIG. 4 is a timing of the accelerator ON. Time t2 in FIG. 4 is a timing at which a pre-charge is performed to suppress a delay of the hydraulic response of the forward clutch 5. Time t3 in FIG. 4 is a timing at which the torque down control is started. Time t4 in FIG. 4 is a timing at which the engagement command of the forward clutch 5 is outputted. Time t5 in FIG. 4 is a timing at which the torque down control is finished.

In this second comparative example, the target torque Tt2 of the internal combustion engine 1 during the torque down control is deficient. That is, in the second comparative example, the target torque Tt2 of the internal combustion engine during the torque down control is set to be smaller than the target torque Tt of the internal combustion engine during the torque down control in the above-described embodiment.

When the torque of the internal combustion engine 1 is deficient during the torque down control, the traveling resistance and the resistance of the power train of the vehicle are not compensated by the torque (the driving force) of the internal combustion engine 1 at the engagement of the forward clutch 5.

Accordingly, the sudden torque variation is transmitted to the CVT 3 at the engagement of the forward clutch 5, so that the shock is generated. This shock is appeared as the variation of the forward and rearward acceleration.

That is, in a case where the target torque Tt2 of the internal combustion engine 1 is low during the torque down control like the second comparative example, the driver may feel, as the unnatural feeling, the deceleration feeling sensed at the engagement of the forward clutch 5 when the torque step (torque level difference) becomes large at the engagement of the forward clutch 5.

Therefore, in the above-described embodiment, in the high vehicle speed, the torque lower limit value Tmin is set to be relatively high so as to prioritize the followability, and to dissolve the unnatural feeling of the driver by below-described reasons.

1) It does not feel the shock due to the ambient noise by the high vehicle speed.

2) When the transmission gear ratio of the CVT 3 is highest, the shock at the engagement of the clutch which is transmitted to the vehicle body becomes substantially a quarter of that when the transmission gear ratio of the CVT 3 is lowest. Accordingly, when the transmission gear ratio of the CVT 3 is highest, the shock is remarkably decreased.

3) In the super high speed (for example, 100 km/h), the sudden followability is needed at the engagement of the clutch to increase the rotation speed of the CVT input shaft 3*a*.

Moreover, in the above-described embodiment, a case of the low vehicle speed is contrary to a case of the high vehicle speed. Accordingly, the torque lower limit value Tmin is set so as not to be extremely large to suppress the acceleration feeling of the driver, and thereby to decrease the unnatural feeling of the driver.

When the accelerator opening degree is large, the acceleration request of the driver is high. Accordingly, the driver is difficult to feel the unnatural feeling by the acceleration and the deceleration. Therefore, the torque lower limit value Tmin is set to be large to prioritize the followability.

When the accelerator opening degree is small, it is contrary to a case of the above-described large accelerator opening degree. Accordingly, the torque lower limit value Tmin is set so as not to be extremely large to suppress the acceleration feeling of the driver, and thereby to decrease the unnatural feeling of the driver.

In this way, in the above-described embodiment, the lower limit value of the torque suppression at the engagement of the lockup clutch and the forward clutch 5 is set in accordance with the driving state. Accordingly, in the above-described embodiment, it is possible to suppress the engagement shock at the engagement of the lockup clutch or the forward clutch 5 while ensuring the response characteristic (the acceleration characteristic) of the vehicle at the restart of the internal combustion engine 1 which is automatically stopped.

Besides, it is conceivable that the engagement time period is increased, that is, the engagement is slowly performed, for decreasing the engagement shock at the torque step at the engagement of the lockup clutch and the forward clutch 5. However, in this case, the durability may be deteriorated due to the friction heat generated at the engagement.

Moreover, in the above-described embodiment, the torque lower limit value Tmin is set in accordance with the vehicle speed and the accelerator opening degree. With this, it is possible to set the torque lower limit value so as to compensate for the traveling resistance (the air resistance and the rolling resistance), and the resistance of the power train of the vehicle.

When the vehicle is in the high vehicle speed, the torque lower limit value Tmin is set to be relatively high so as to generate the torque to compensate for the traveling resistance of the vehicle which is greater as the vehicle speed is higher. With this, it is possible to ensure the response characteristic (the acceleration characteristic) of the vehicle at the restart of the internal combustion engine 1 which is automatically stopped.

When the vehicle is in the low vehicle speed, the traveling resistance of the vehicle is relatively small. The transmission gear ratio of the CVT 3 is the low side. Accordingly, the torque lower limit value Tmin is set to be relatively low. With this, it is possible to decrease the unnecessary acceleration feeling generated at the engagement of the lockup clutch and the forward clutch 5.

When the accelerator opening degree is large, the torque lower limit value Tmin is set to be relatively high. With this, it is possible to suppress the response delay of the torque, and to ensure the response characteristic (the acceleration characteristic) of the vehicle at the restart of the internal combustion engine 1 which is automatically stopped.

When the accelerator opening degree is small, the torque lower limit value Tmin is set to be relatively low. With this, it is possible to decrease the unnecessary acceleration feeling at the engagement of the lockup clutch and the forward clutch 5.

Besides, when the accelerator opening degree is full open when the automatic restart condition is satisfied, the acceleration intention of the driver is large. Accordingly, the torque lower limit value Tmin is set to the maximum value to satisfy the acceleration intention of the driver, irrespective of the vehicle speed. That is, when the accelerator opening degree is full open when the automatic restart condition is satisfied, the torque lower limit value Tmin is set to a predetermined constant full open value, irrespective of the vehicle speed.

Moreover, when the accelerator opening degree is full close when the automatic restart condition is satisfied, there is no acceleration intention of the driver. Accordingly, the torque lower limit value Tmin is set to the minimum value, irrespective of the vehicle speed. That is, when the accelerator opening degree is full close when the automatic restart condition is satisfied, the torque lower limit value Tmin is set to a predetermined constant full close value, irrespective of the vehicle speed.

Figure 5:
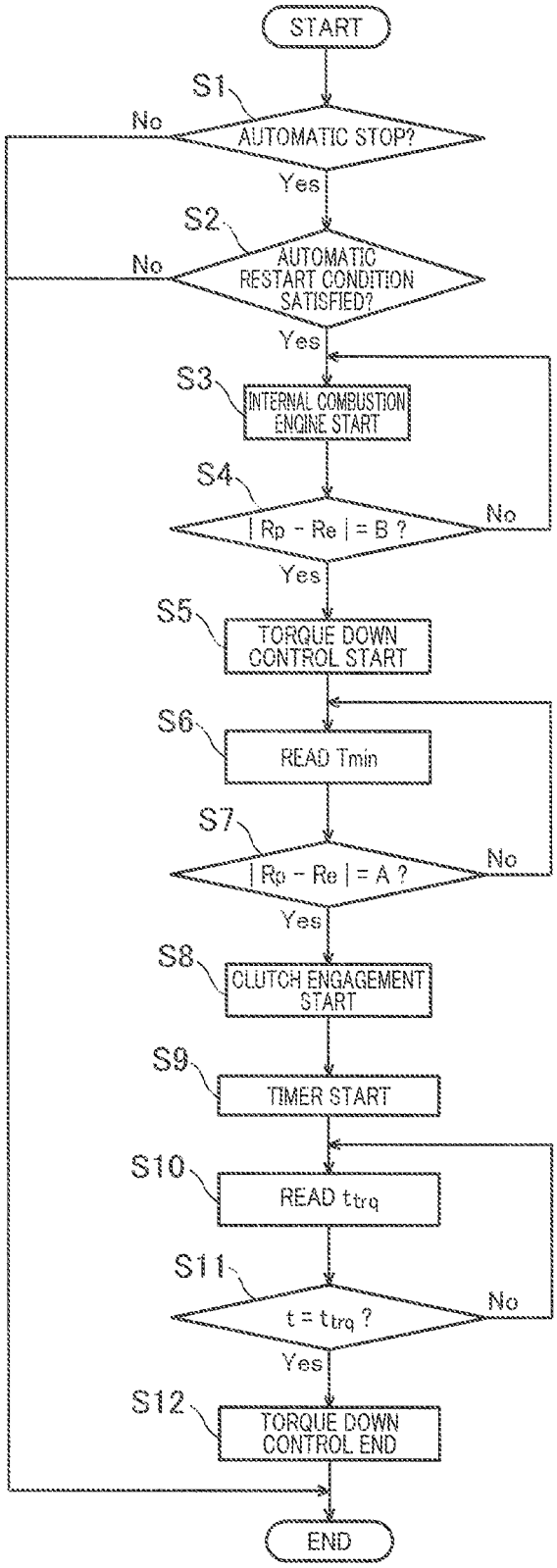
FIG. 5 is a flowchart showing one example of a flow of a control of the internal combustion engine in the present invention.
Figure 6:
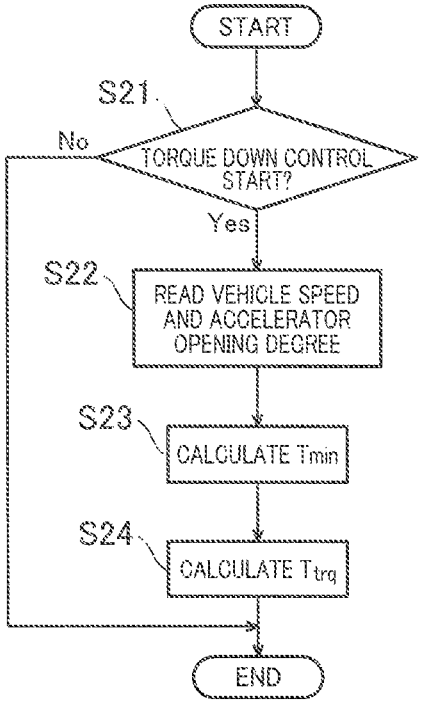
FIG. 6 is a flowchart showing one example of a flow of a control of the internal combustion engine in the present invention.

FIG. 5 and FIG. 6 are flowcharts showing a flow of the control of the internal combustion engine according to the present invention. FIG. 5 is a flowchart showing one example of the flow of the control at the restart of the internal combustion engine. FIG. 6 is a flowchart showing one example of the flow of the control when the torque lower limit value Tmin and the torque release time period $t_{trq}$ are calculated.

Firstly, FIG. 5 is explained.

At step S1, it is judged whether or not the internal combustion engine 1 is automatically stopped during the traveling. When it is judged that the internal combustion engine 1 is automatically stopped during the traveling at step S1, the process proceeds to step S2. When it is judged that the internal combustion engine 1 is not automatically stopped during the traveling at step S1, this routine is finished.

At step S2, it is judged whether or not the automatic restart condition is satisfied. When it is judged that the automatic restart condition is satisfied at step S2, the process proceeds to step S3. When it is judged that the automatic restart condition is not satisfied at step S2, this routine is finished.

At step S3, the internal combustion engine 1 is started.

At step S4, it is judged whether or not the rotation speed difference between the engine speed Re of the internal combustion engine 1 and the rotation speed Rp of the primary pulley 11 of the CVT 3 becomes the second predetermined value B. When it is judged that the rotation speed difference between the engine speed Re of the internal combustion engine 1 and the rotation speed Rp of the primary pulley 11 of the CVT 3 becomes the second predetermined value B at step S4, the process proceeds to step S5. When it is judged that the rotation speed difference between the engine speed Re of the internal combustion engine 1 and the rotation speed Rp of the primary pulley 11 of the CVT 3 does not become the second predetermined value B at step S4, the process proceeds to step S3.

At step S5, the torque down control is started.

At step S6, the torque lower limit value Tmin which is the target torque in the torque down control is read. This torque lower limit value Tmin is calculated by using the vehicle speed and the accelerator opening degree. The torque lower limit value Tmin is varied in accordance with the driving state during the torque down control. That is, the torque lower limit value Tmin is varied in accordance with the vehicle speed and the accelerator opening degree during the torque down control.

At step S7, it is judged whether or not the rotation speed difference between the engine speed Re of the internal combustion engine 1 and the rotation speed Rp of the primary pulley 11 of the CVT 3 becomes the first predetermined value A. The first predetermined value A is set to be smaller than the second predetermined value B. When it is judged that the rotation speed difference between the engine speed Re of the internal combustion engine 1 and the rotation speed Rp of the primary pulley 11 of the CVT 3 becomes the first predetermined value A at step S7, the process proceeds to step S8. When it is judged that the rotation speed difference between the engine speed Re of the internal combustion engine 1 and the rotation speed Rp of the primary pulley 11 of the CVT 3 does not become the first predetermined value A at step S7, the process proceeds to step S5.

At step S8, the clutch engagement is started. That is, the engagement of the forward clutch 5 is started at the recovery from the sailing stop. The engagement of the lockup clutch is started at the recovery from the coast stop.

At step S9, the timer to measure Actually, this timer is started from the timing at which the rotation speed difference between the engine speed Re and the rotation speed Rp of the primary pulley 11 becomes the first predetermined value A.

At step S10, the torque release time period $t_{trq}$ is read. This torque release time period $t_{trq}$ is calculated by using the vehicle speed and the accelerator opening degree. The torque release time period $t_{trq}$ is varied in accordance with the driving state during the torque down control. That is, the torque release time period $t_{trq}$ is varied in accordance with the vehicle speed and the accelerator opening degree during the torque down control.

At step S11, it is judged whether or not the torque release time period $t_{trq}$ is elapsed from the start of the timer. When it is judged that the torque release time period $t_{trq}$ is elapsed from the start of the timer at step S11, the process proceeds to step S12. When it is judged that the torque release time period $t_{trq}$ is not elapsed from the start of the timer at step S11, the process proceeds to step S10.

At step S12, the torque down control is finished.

Next, FIG. 6 is explained.

At step S21, it is judged whether or not the torque down control is started. When it is judged that the torque down control is started (performed) at step S21, the process proceeds to step S22. When it is judged that the torque down control is not started (performed) at step S21, this routine is finished.

At step s22, the vehicle speed and the accelerator opening degree are read.

At step S23, the torque lower limit value Tmin is calculated by using the vehicle speed and the accelerator opening degree.

At step S24, the torque release time period $t_{trq}$ is calculated by using the vehicle speed and the accelerator opening degree.

The current torque lower limit value Tmin calculated at step S23 is read at step S6 of FIG. 5.

The current torque release time period $t_{trq}$ calculated at step S24 is read at step S10 of FIG. 5.

Besides, the above-described embodiment relates to the control method and the control device for the internal combustion engine.

Moreover, the present invention is applicable to the restart of the internal combustion engine 1 which is in the sailing stop state, and the restart of the internal combustion engine 1 which is in the coast stop state.

The invention claimed is:

1. A control method for an internal combustion engine in which a driving force is transmitted through a clutch to a driving wheel of a vehicle, the control method comprising:

when the internal combustion engine which is automatically stopped in a state where the clutch is disengaged is restarted, performing a torque down control to decrease a target torque of the internal combustion engine when the clutch is engaged; and setting a target torque in the torque down control, to a predetermined torque lower limit value determined in accordance with a driving state, the torque lower limit value including at least one of a predetermined full open value set when an accelerator opening degree is full open, and a predetermined full close value set when the accelerator opening degree is full close.

2. The control method for the internal combustion engine as claimed in claim 1, wherein the torque lower limit value is set to compensate for a traveling resistance of the vehicle and a resistance of a power train of the vehicle.

3. The control method for the internal combustion engine as claimed in claim 1, wherein the torque down control is started when a rotation speed difference between an engine speed of the internal combustion engine, and an input side rotation speed of a transmission connected through the clutch to the internal combustion engine becomes a predetermined value.

4. The control method for the internal combustion engine as claimed in claim 1, wherein the torque lower limit value is set to be larger as a vehicle speed is higher.

5. A control device for an internal combustion engine, the control device comprising:

an internal combustion engine arranged to transmit a driving force of a driving wheel of a vehicle;

a clutch disposed between the internal combustion engine and the driving wheel;

a torque down control section configured to perform a torque down control to decrease a target torque of the internal combustion engine to be equal to or greater than a predetermined torque lower limit value when the clutch is engaged; and a torque lower limit value calculation section configured to set a predetermined lower limit value determined in accordance with a driving state, the torque lower limit value calculation section being configured to calculate the torque lower limit value so as to include at least one of a predetermined full open value set when an accelerator opening degree is full open, and a predetermined full close value set when the accelerator opening degree is full close.

6. The control method for the internal combustion engine as claimed in claim 1, wherein the torque lower limit value is set to be larger as an accelerator opening degree is greater.

* * * * *